US010239073B2

(12) United States Patent
Jin

(10) Patent No.: US 10,239,073 B2
(45) Date of Patent: Mar. 26, 2019

(54) SEALER CIRCULATING SYSTEM

(71) Applicants: Hyundai Motor Company, Seoul (KR); Kia Motors Corporation, Seoul (KR)

(72) Inventor: Taeheun Jin, Gyeongsangbuk-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/598,625

(22) Filed: May 18, 2017

(65) Prior Publication Data

US 2018/0161789 A1 Jun. 14, 2018

(30) Foreign Application Priority Data

Dec. 14, 2016 (KR) ..... 10-2016-0170812

(51) Int. Cl.
*B05B 7/02* (2006.01)
*B05B 13/04* (2006.01)
*B05B 15/50* (2018.01)

(52) U.S. Cl.
CPC ..... *B05B 7/02* (2013.01); *B05B 13/0431* (2013.01); *B05B 15/50* (2018.02); *B05B 13/0452* (2013.01)

(58) Field of Classification Search
USPC ..... 118/300, 323, 321, 684, 692, 679–681, 118/666, 667
See application file for complete search history.

(56) References Cited

U.S. PATENT DOCUMENTS 4,998,502 A * 3/1991 Schucker ..... B01F 5/0615 118/302
6,089,469 A * 7/2000 Fusama ..... B05C 11/1013 239/124
7,967,168 B2 * 6/2011 Geier ..... G05D 7/0676 222/1
2005/0253914 A1 * 11/2005 Yokoyama ..... B41J 11/002 347/102
2012/0135194 A1 * 5/2012 Takeda ..... B05D 7/54 428/156

* cited by examiner

*Primary Examiner* — Yewebdar T Tadesse
(74) *Attorney, Agent, or Firm* — Mintz Levin Cohn Ferris Glovsky and Popeo, P.C.; Peter F. Corless

(57) ABSTRACT

A system for circulating a sealer is provided. The system includes a circulation line, in which a sealer is circulated and a first circulation valve which is disposed in the circulation line and configured to control the circulated sealer. A supply line is branched from a front end of the first circulation valve and an applying gun which is disposed in the supply line, receives a sealer, and controls the sealer discharged to the outside through a nozzle.

11 Claims, 7 Drawing Sheets

SEALER CIRCULATING SYSTEM

CROSS-REFERENCE TO RELATED APPLICATION

This application claims priority to and the benefit of Korean Patent Application No. 10-2016-0170812 filed in the Korean Intellectual Property Office on Dec. 14, 2016, the entire contents of which are incorporated herein by reference.

BACKGROUND

(a) Field of the Invention

The present invention relates to a sealer circulating system, and more particularly, to a sealer circulating system that includes a circulation line circulating a sealer to automatically embrocate a sealer to a roof ditch of a vehicle.

(b) Description of the Related Art

In a vehicle, an attachment part between a roof and a side panel is fastened with a roof molding after spot welding. However, productivity may be degraded and a mounting error may occur while an operator fastens the roof molding to fasten the roof molding to a ditch part. Recently, a technology for automatically applying a sealer to a roof attachment part, instead of a roof molding, to remove the roof molding, and improving a quality of an exterior appearance has been developed. Further, research regarding a method and an apparatus for improving a quality of a sealer application, improving application accuracy, and improving a product quality is continuously being conducted.

The above information disclosed in this section is merely for enhancement of understanding of the background of the invention and therefore it may contain information that does not form the prior art that is already known in this country to a person of ordinary skill in the art.

SUMMARY

The present invention provides a sealer circulating system, which automatically applies a sealer to a roof ditch of a vehicle to improve both productivity and a product quality.

An exemplary embodiment of the present invention provides a system for circulating a sealer that may include: a circulation line, in which a sealer is circulated; a first circulation valve, disposed in the circulation line and configured to control the circulated sealer; a supply line branched from a front end of the first circulation valve; and an applying gun, disposed in the supply line, configured to receive a sealer, and control the sealer discharged to the outside through a nozzle.

The system may further include: a supply valve disposed to control the sealer transferred to the applying gun in the supply line; and a cylinder, disposed between the supply valve and the applying gun and configured to pressure-feed the sealer to the applying gun. Additionally, the system may include a discharge line, through which the sealer remaining after the injection from the applying gun is discharged, and which is joined to the circulation line. The system may further include a second circulation valve, configured to control the discharged sealer, in the discharge line.

The system may further include a robot, in which the applying gun may be disposed at a front end of an arm of the robot and a controller disposed to operate the robot, the applying gun, the supply valve, the cylinder, the first circulation valve, and the second circulation valve. In a continuous applying mode, in which an applying operation continues for a predetermined period of time, the controller may be configured to open the first circulation valve, open the supply valve, operate the cylinder, open an outlet of the applying gun, and close the second circulation valve.

In a short-term pause mode, in which an applying operation is stopped for less than a predetermined period of time, the controller may be configured to close the first circulation valve, open the supply valve, operate the cylinder, close an outlet of the applying gun, and open the second circulation valve. In a long-term pause mode, in which an applying operation is stopped for a predetermined period of time or longer, the controller may be configured to close the first circulation valve, close the supply valve, not operate the cylinder, close an outlet of the applying gun, and close the second circulation valve.

The system may further include a filling unit, disposed so that the sealer is filled in the circulation line through a filling line connected to one side of the circulation line. The filling unit may include: a sealer storing unit, in which the sealer to be supplied is contained; a filing pump configured to pump the sealer contained in the sealer storing unit to the circulating unit; and a filling motor configured to apply rotational force to the supply pump.

The system may further include a temperature compensating unit, disposed in the circulation line and configured to adjust a temperature of the circulated sealer within a predetermined temperature range. The temperature compensating unit may include: a heating/cooler, configured to heat the sealer or cool the sealer by a supplied power source; and a heat radiator, configured to absorb heat of the sealer and discharge the heat to the outside. The heating/cooler may include a thermoelectric element, and the heat radiator may include a heatsink and a cooling fan, in which heat energy is stored.

Additionally, the temperature compensating unit may include a temperature detecting unit configured to detect a temperature of the circulated sealer. The system may further include a circulating unit disposed in the circulation line and configured to circulate the sealer along the circulation line. The circulating unit may include: a filter configured to filter foreign substances included in the sealer; a pressure detecting unit configured to detect a pressure of the circulated sealer; and a circulation pump configured to circulate the sealer through the circulation line.

According to the exemplary embodiment of the present invention, the sealer circulating system may vary a circulation direction based on the continuous applying mode, the short-term pause mode, and the long-term pause mode, to stably maintain a temperature of a sealer applied to a roof ditch and improve a quality of the circulated sealer.

BRIEF DESCRIPTION OF THE DRAWINGS

These and/or other aspects of the invention will become apparent and more readily appreciated from the following description of the exemplary embodiments, taken in conjunction with the accompanying drawings of which.

DETAILED DESCRIPTION

Figure 1:
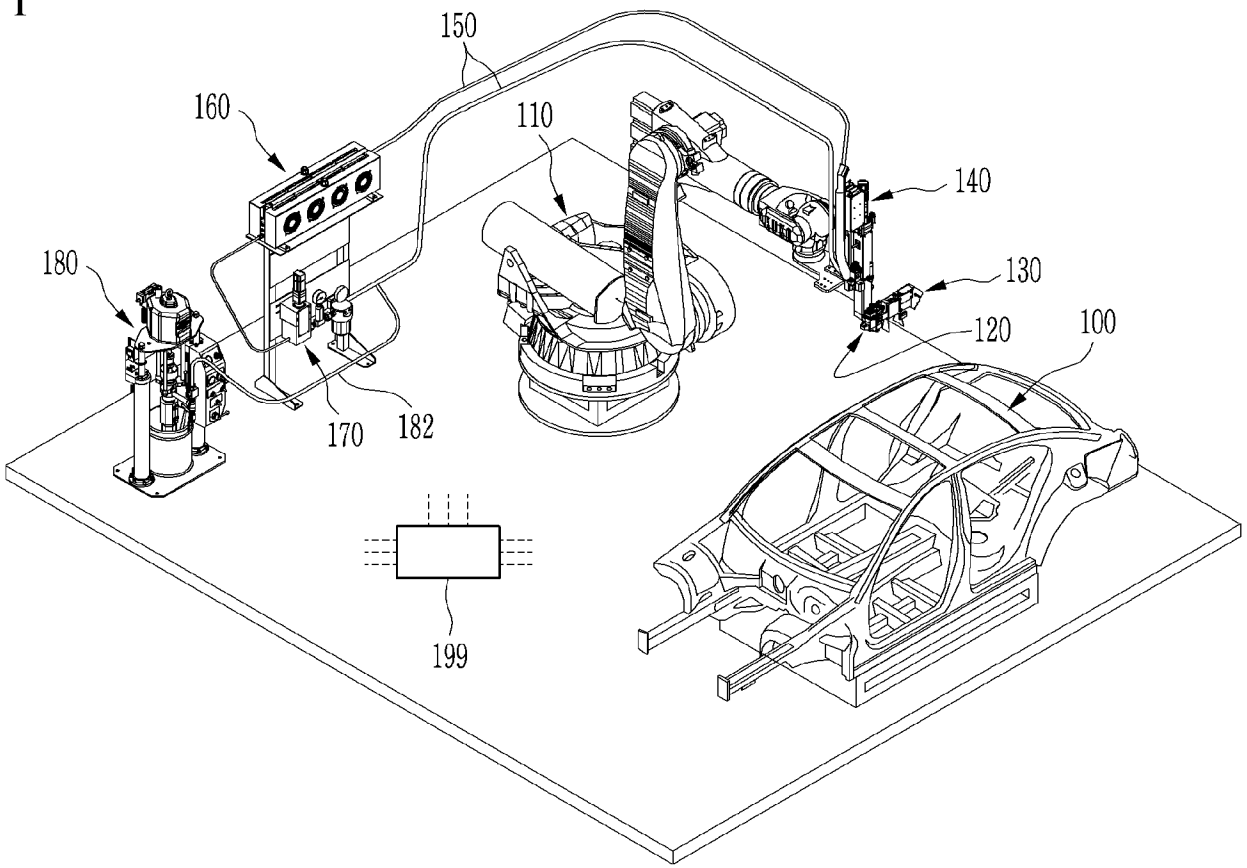
FIG. 1 is a general configuration diagram of a sealer circulating system according to an exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Furthermore, control logic of the present invention may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, an exemplary embodiment of the present invention will be described in detail with reference to the accompanying drawings. In addition, the size and thickness of each configuration shown in the drawings are arbitrarily shown for understanding and ease of description, but the present invention is not limited thereto, and the thickness of layers, films, panels, regions, etc., are exaggerated for clarity. A part irrelevant to the description will be omitted to clearly describe the exemplary embodiment of the present invention, and the same elements will be designated by the same reference numerals throughout the specification. In a description below, names of constituent elements are discriminatingly used as "a first . . . ", a second . . . ", and the like, but this is for discriminating the same name of the constituent element, and the name of the constituent element is not limited to the order.

FIG. 1 is a general configuration diagram of a sealer circulating system according to an exemplary embodiment of the present invention. Referring to FIG. 1, the sealer circulating system may include a filling unit 180, a filling line 182, a circulating unit 170, a temperature compensating unit 160, a circulation line 150, a robot 110, a quantitative discharging unit 140, an applying gun 120, a vision 130, a vehicle body 100, and a controller 199 as main constituent elements. The controller 199 may include a memory and a processor and may be configured to operate the components of the system (e.g., the units listed above).

In particular, the filling unit 180 may be configured to fill the circulation line 150 with a sealer through the filling line 182, the circulating unit 170 may be configured to circulate the sealer along the circulation line 150, and the temperature compensating unit 160 may be configured to adjust a temperature of the sealer moving along the circulation line 150 to correspond to a predetermined temperature range. The quantitative discharging unit 140 may be configured to pressure-feed the predetermined quantity of sealer to the applying gun 120, and the applying gun 120 may be configured to discharge the sealer to the outside through a nozzle 260, and the vision 130 may be configured to detect a form of the vehicle body 100 and detect a form of the applied sealer. The applying gun 120 and the vision 130 may be disposed at a front end of an arm of the robot 110, and the robot 110 may be operate by the controller 199 to move the applying gun 120 and the vision 130 along a predetermined route (e.g., along a guide).

As mentioned, the controller 199 may be configured to operate the filling unit 180, the circulating unit 170, the temperature compensating unit 160, the quantitative discharging unit 140, and the applying unit 120, and detect the form and a profile of the vehicle body 100 using the vision 130, calculate a quality of the applied sealer, and operate the robot 110. The controller 199 may be implemented by one or more micro-processors operated by a predetermined program, and the predetermined program may include a series of commands for performing a method according to an exemplary embodiment of the present invention to be described below.

Figure 2A:
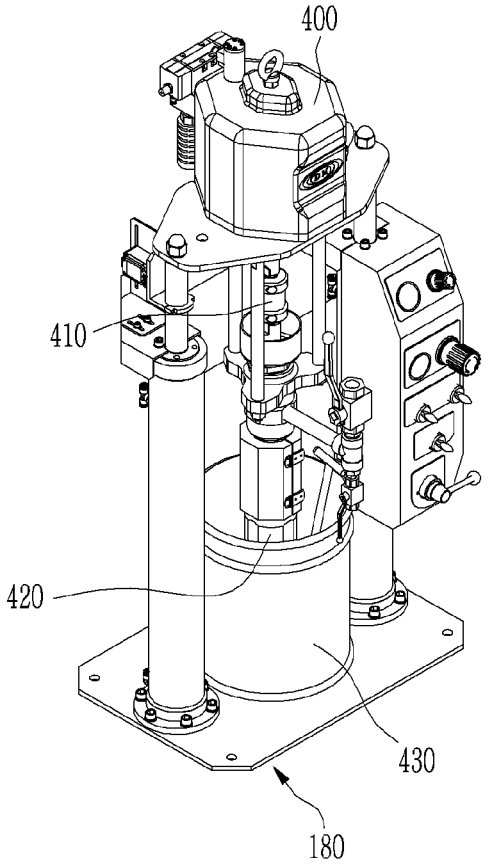
FIG. 2A is a perspective view of a part of a supplying unit in the sealer circulating system according to the exemplary embodiment of the present invention.

FIG. 2A is a perspective view of a part of a supplying unit in the sealer circulating system according to the exemplary embodiment of the present invention. Referring to FIG. 2A, the filling unit 180 may include a sealer storing unit 430 (e.g., a storage tank), a filling pump 420, a coupling 410, and a filling motor 400 as constituent elements. The filling motor 400 provides rotational force to the filling pump 420 through the coupling 410, and the filling pump 420 may be configured to pump the sealer contained in the sealer storing unit 430 and supplement the circulation line 150 with the sealer through the filling line 182.

Figure 2B:
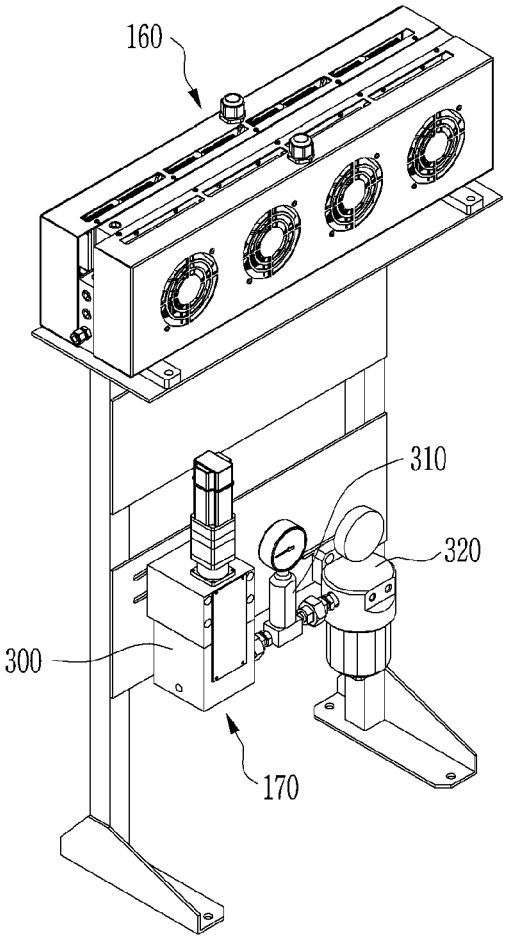
FIG. 2B is a perspective view of a part of a temperature compensating unit and a circulating unit in the sealer circulating system according to the exemplary embodiment of the present invention.

FIG. 2B is a perspective view of a part of the temperature compensating unit and the circulating unit in the sealer circulating system according to the exemplary embodiment of the present invention. Referring to FIG. 2B, the circulating unit 170 may include a filter 320, a pressure detecting unit 310 (e.g., a pressure sensor), and a circulation pump 300 as constituent elements. The filter 320 may be configured to filter foreign substances from the sealer circulating the circulation line, the pressure detecting unit 310 may be configured to detect a pressure of the circulated sealer, and the circulation pump 300 may be configured to circulate the sealer along the circulation line 150.

The temperature compensating unit 160 may be configured to adjust a temperature of the sealer that circulates along the circulation line 150 within a predetermined temperature range, and thus, the temperature compensating unit 160 may include a temperature detecting unit or temperature sensor (not illustrated). Further, the temperature compensating unit 160 may include a heater configured to heat a sealer, a cooler configured to cool a sealer, and a heat radiator configured to radiate heat, and the heater and the cooler may use a thermoelectric element, and the heat discharging unit may include a heatsink and a heat radiating fan configured to absorb heat.

Figure 2C:
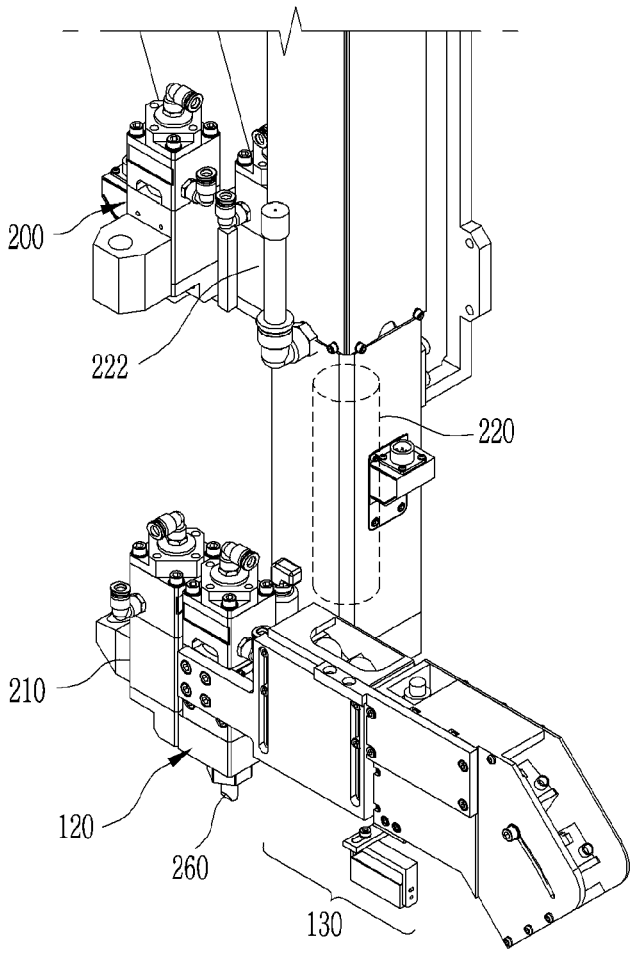
FIG. 2C is a perspective view of a part of a quantitative discharging unit in the sealer circulating system according to the exemplary embodiment of the present invention.

FIG. 2C is a perspective view of a part of the quantitative discharging unit in the sealer circulating system according to the exemplary embodiment of the present invention. Referring to FIG. 2C, the quantitative discharging unit 140 may include a discharge motor (not illustrated), a ball screw (not illustrated), and a cylinder 220. The discharge motor may be configured to pressure-feed the sealer filled in the cylinder 220 to the applying gun 120 through the ball screw.

Particularly, the applying gun 120 may be disposed at a front end of the cylinder 220, and a nozzle 260, through which the sealer is discharged to the outside (e.g., extraneous to the system), may be disposed at a lower end of the applying gun 120. A supply valve 222 and a first circulation valve 200 may be disposed at one side of the quantitative discharging unit 140, and a second circulation valve 210 may be disposed at one side of the applying gun 120. The functions and the positions of the first circulation valve 200, the supply valve 222, and the second circulation valve 210 will be described with reference to FIGS. 3, 4, and 5.

Figure 3:
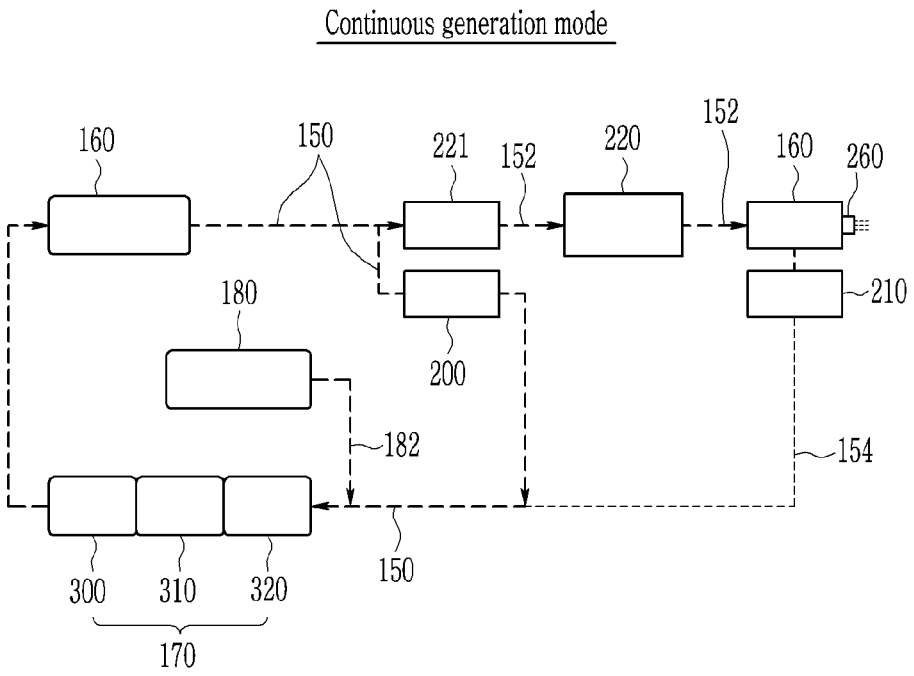
FIG. 3 is a schematic configuration diagram illustrating a movement of a sealer in a continuous generation mode of the sealer circulating system according to the exemplary embodiment of the present invention.

FIG. 3 is a schematic configuration diagram illustrating a movement of a sealer in a continuous generation mode of the sealer circulating system according to the exemplary embodiment of the present invention. Referring to FIG. 3, the circulation line 150 forms one closed loop, and the temperature compensating unit 160, the first circulation valve 200, and the circulating unit 170 may be disposed at predetermined positions of the circulation line 150. Further, the filling line 182 may connect the circulation line 150 and the filling unit 180.

The supply line 152 may be branched from the circulation line 150 at a rear end of the first circulation valve 200, and may be connected to a sealer inlet of the applying gun 120. The cylinder 220 may be disposed between the first circulation valve 200 and the applying gun 120, and the cylinder 220 may be configured to pressure-feed the sealer supplied through the first circulation valve 200 to the applying gun 120. The discharge line 154 may be joined to a rear end of the first circulation valve 200 of the circulation line 150 at a discharge side of the applying gun 120. Further, the second circulation valve 210 may be disposed at the discharge side of the applying gun 120 in the discharge line 154.

In a continuous generation mode, in which the sealer is continuously injected from the applying gun 120, the filling unit 180 may be configured to fill the circulation line 150 with the sealer through the filling line 182, and the sealer may sequentially circulate through the filter 320, the pressure detecting unit 310, the circulation pump 300, the temperature compensating unit 160, and the first circulation valve 200. Further, the sealer supplied through the supply line 152 may be supplied to the applying gun 120 through the supply valve 222 and the cylinder 220, and may be injected from the nozzle 260 and applied to a ditch area of the vehicle body 100.

In the exemplary embodiment of the present invention, the controller 199 may be configured to open the supply valve 222, operate the cylinder 220, and open an outlet of the applying gun 120 in the continuous generation mode. Further, the controller 199 may be configured to open the first circulation valve 200 and close the second circulation valve 210. The controller 199 may then be configured to operate the temperature compensating unit 160, the filling unit 180, and the circulating unit 170.

Figure 4:
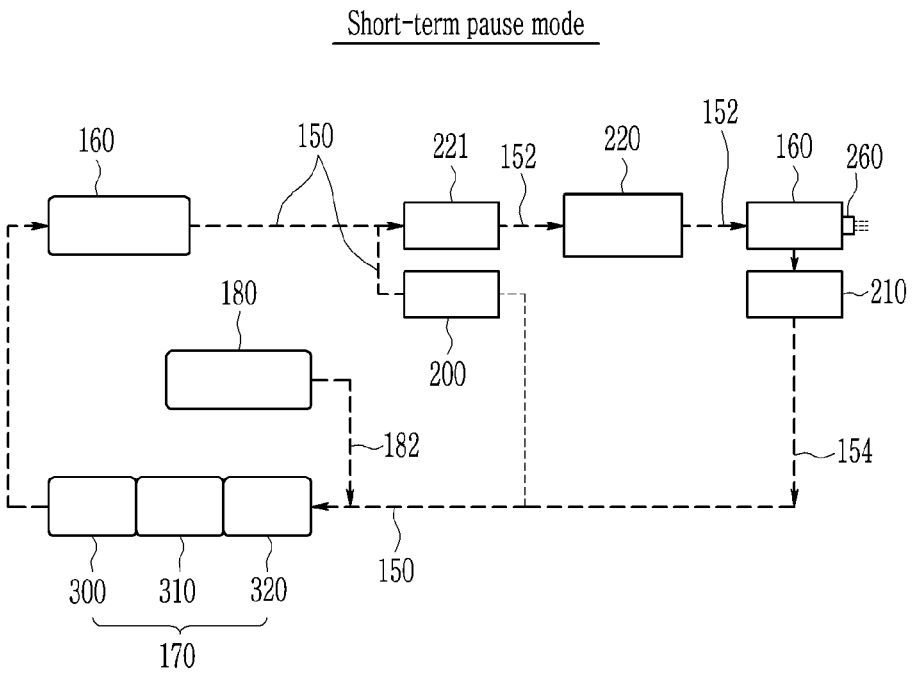
FIG. 4 is a schematic configuration diagram illustrating a movement of a sealer in a short-term pause mode of the sealer circulating system according to the exemplary embodiment of the present invention.

FIG. 4 is a schematic configuration diagram illustrating a movement of the sealer in a short-term pause mode of the sealer circulating system according to the exemplary embodiment of the present invention. Referring to FIG. 4, in a short-term pause mode, in which the sealer is not injected from the applying gun 120 for a predetermined period of time or less, the sealer may sequentially circulate through the filter 320, the pressure detecting unit 310, the circulation pump 300, the temperature compensating unit 160, the supply valve 222, the cylinder 220, the applying gun 120, and the second circulation valve 210. Then, the first circulation valve 200 may be closed by the controller 199.

In the exemplary embodiment of the present invention, the controller 199 may be configured to open the supply valve 222, operate the cylinder 220, and close the outlet of the applying gun 120 in the short-term pause mode. Further, the controller 199 may be configured to close the first circulation valve 200 and open the second circulation valve 210. The controller 199 may then be configured to operate the temperature compensating unit 160 and the filling unit 180.

Figure 5:
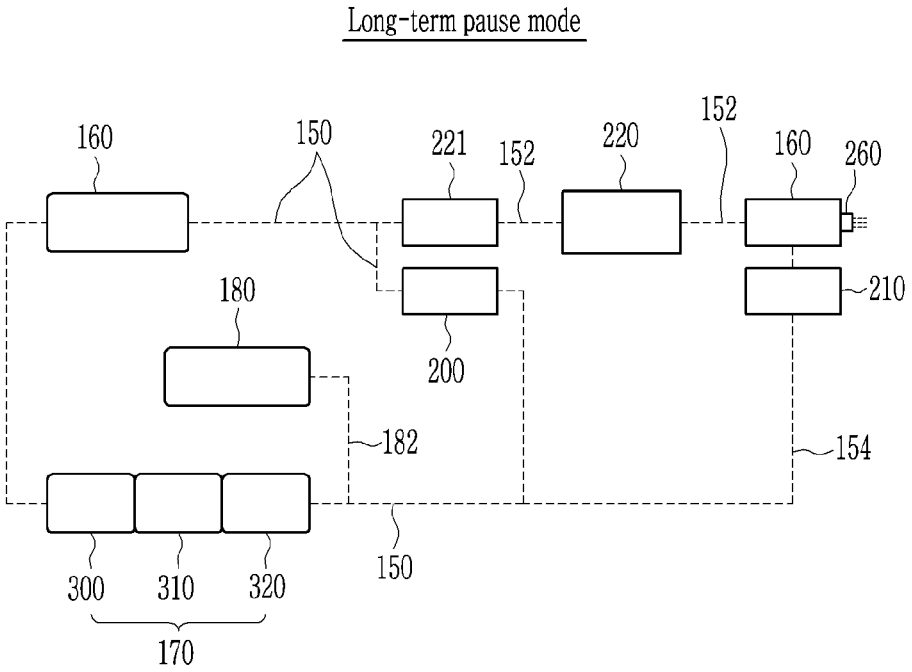
FIG. 5 is a schematic configuration diagram illustrating a movement of a sealer in a long-term pause mode of the sealer circulating system according to the exemplary embodiment of the present invention.

FIG. 5 is a schematic configuration diagram illustrating a movement of the sealer in a long-term pause mode of the sealer circulating system according to the exemplary embodiment of the present invention. Referring to FIG. 4, in a long-term pause mode, in which the sealer is not injected from the applying gun 120 for a predetermined period of time or longer, the controller 199 does not operate the circulating unit 170 (prevents operation thereof) and may be configured to close the outlet of the applying gun 120. Further, the controller 199 may be configured to close the first circulation valve 200 and the second circulation valve 210. The controller 199 may then be configured to stop the operations of the temperature compensating unit 160 and the filling unit 180.

While this invention has been described in connection with what is presently considered to be exemplary embodiments, it is to be understood that the invention is not limited to the disclosed exemplary embodiments, but, on the contrary, is intended to cover various modifications and equivalent arrangements included within the spirit and scope of the appended claims.

DESCRIPTION OF SYMBOLS

100: Vehicle body
110: Robot
120: Applying gun
130: Vision
140: Quantitative discharging unit
150: Circulation line
152: Supply line
154: Discharge line
160: Temperature compensating unit
170: Circulating unit
180: Filling unit
182: Filling line
199: Controller
200: First circulation valve
210: Second circulation valve
220: Cylinder
222: Supply valve
260: Nozzle
300: Circulation pump
310: Pressure detecting unit
320: Filter
400: Filling motor
410: Coupling
420: Filling pump
430: Sealer storing unit

What is claimed is:

1. A system for circulating a sealer, comprising:
a circulation line in which a sealer is circulated;
a first circulation valve disposed in the circulation line and configured to control the circulated sealer;
a supply line branched from a front end of the first circulation valve;
an applying gun disposed in the supply line and configured to receive the sealer and control the sealer discharged to the outside through a nozzle;
a supply valve configured to control the sealer transferred to the applying gun in the supply line;
a cylinder disposed between the supply valve and the applying gun and configured to pressure-feed the sealer to the applying gun;
a discharge line, through which the sealer remaining after the injection from the applying gun is discharged, and which is joined to the circulation line;
a second circulation valve configured to control the discharged sealer in the discharge line;
a robot in which the applying gun is disposed at a front end of an arm of the robot; and
a controller configured to operate the robot, the applying gun, the supply valve, the cylinder, the first circulation valve, and the second circulation valve, the system for circulating a sealer vary circulating direction in a continuous applying mode, a short-term pause mode and a long-term pause mode,
wherein in the continuous applying mode, in which an applying operation continues for a predetermined period of time, the controller is configured to open the first circulation valve, open the supply valve, operate the cylinder, open an outlet of the applying gun, and close the second circulation valve.

2. The system of claim 1, wherein in the short-term pause mode, in which an applying operation is stopped for less than a predetermined period of time, the controller is configured to close the first circulation valve, open the supply valve, operate the cylinder, close an outlet of the applying gun, and open the second circulation valve.

3. The system of claim 1, wherein in the long-term pause mode, in which an applying operation is stopped for a predetermined period of time or longer, the controller is configured to close the first circulation valve, close the supply valve, prevent operation of the cylinder, close an outlet of the applying gun, and close the second circulation valve.

4. The system of claim 1, further comprising:
a filling unit disposed so that the sealer is filled in the circulation line through a filling line connected to one side of the circulation line.

5. The system of claim 4, wherein: the filling unit includes:
a sealer storing unit in which the sealer to be supplied is contained;
a filing pump configured to pump the sealer contained in the sealer storing unit to the circulating unit; and
a filling motor configured to apply rotational force to the supply pump.

6. The system of claim 1, further comprising:
a temperature compensating unit disposed in the circulation line and configured to adjust a temperature of the circulated sealer within a predetermined temperature range.

7. The system of claim 6, wherein the temperature compensating unit includes:
a heater/cooler, configured to heat the sealer or cool the sealer by a supplied power source; and
a heat radiator configured to absorb heat of the sealer and discharge the heat to the outside.

8. The system of claim 7, wherein the heater/cooler includes a thermoelectric element and the heat radiator includes a heatsink and a cooling fan in which heat energy is stored.

9. The system of claim 7, wherein the temperature compensating unit includes:
a temperature detecting unit configured to detect a temperature of the circulated sealer.

10. The system of claim 1, further comprising:
a circulating unit disposed in the circulation line and configured to circulate the sealer along the circulation line.

11. The system of claim 10, wherein the circulating unit includes:
a filter configured to filter foreign substances included in the sealer;
a pressure detecting unit configured to detect a pressure of the circulated sealer; and
a circulation pump configured to circulate the sealer through the circulation line.

* * * * *